US007731416B2

(12) United States Patent
Mahler et al.

(10) Patent No.: US 7,731,416 B2
(45) Date of Patent: Jun. 8, 2010

(54) TIME-SETTING MEMBER FOR A TIME INDICATOR

(75) Inventors: Olivier Mahler, Boecourt (CH); Alphonse Bron, Bassecourt (CH)

(73) Assignee: Compagnie des Montres Longines, Francillon S.A., St-Imier (CH)

( * ) Notice: Subject to any disclaimer, the term of this patent is extended or adjusted under 35 U.S.C. 154(b) by 48 days.

(21) Appl. No.: 11/955,970

(22) Filed: Dec. 13, 2007

(65) Prior Publication Data

US 2008/0144444 A1 Jun. 19, 2008

(30) Foreign Application Priority Data

Dec. 13, 2006 (EP) ..... 06126025

(51) Int. Cl.
*G04B 27/02* (2006.01)

(52) U.S. Cl. ..... 368/190; 368/184

(58) Field of Classification Search ..... 368/21, 368/22, 69, 76, 184, 185, 190, 193
See application file for complete search history.

(56) References Cited

U.S. PATENT DOCUMENTS 3,844,107 A * 10/1974 Guyot ..... 368/22
4,862,434 A * 8/1989 Hiraga et al. ..... 368/190
5,184,333 A * 2/1993 Caspar ..... 368/28
5,504,721 A * 4/1996 Calabrese ..... 368/185
6,179,464 B1 * 1/2001 Bettelini ..... 368/185
6,270,251 B1 * 8/2001 Bron ..... 368/320
2005/0128875 A1 * 6/2005 Bron ..... 368/21

FOREIGN PATENT DOCUMENTS

| | | |
|---|---|---|
| CH | 340191 | 9/1959 |
| EP | 0 366 610 | 5/1990 |
| EP | 1 058 166 A2 | 12/2002 |
| EP | 1 544 691 A1 | 6/2005 |
| FR | 743 618 | 4/1933 |

OTHER PUBLICATIONS

European Search Report issued in corresponding application No. EP 06 12 6025, completed Aug. 9, 2007.

* cited by examiner

*Primary Examiner*—Renee S Luebke
*Assistant Examiner*—Jason Collins
(74) *Attorney, Agent, or Firm*—Griffin & Szipl, P.C.

(57) ABSTRACT

During normal use, the time indicator (2) is driven by a mechanism (3) controlled by the gear train (4) of the time-piece. This mechanism is arranged for uncoupling the gear train from the indicator when the time-setting member (1) is actuated, this action causing the indicator to move forward through a step of one hour. The time-setting member includes a push-button (5) which actuates a device (6) that in turn acts on said mechanism (3).

8 Claims, 4 Drawing Sheets

TIME-SETTING MEMBER FOR A TIME INDICATOR

CROSS REFERENCE TO RELATED APPLICATIONS

This application claims priority from European Patent Application No. 06126025.3 filed Dec. 13, 2006, the entire disclosure of which is incorporated herein by reference.

FIELD OF THE INVENTION

The present invention relates to a time-setting member for a timepiece time indicator, said indicator being driven during normal use by a mechanism controlled by the gear train comprised in said timepiece, the mechanism being arranged for uncoupling said gear train from said indicator when the time-setting member is actuated, this action then causing the indicator to move forward in a one hour step.

BACKGROUND OF THE INVENTION

This type of device is known from and disclosed in EP Patent No. A-1544691. In that document, the timepiece includes an hour hand able to be moved forward through one-hour steps by means of a manually actuated time-setting stem without affecting the minute display. In order to do so, the hour hand is constantly coupled to the going train, i.e. to the motor element carried by the timepiece except at the moment when the time is set when said hand is uncoupled from the going train, the rotation of the stem then moving said hand forward one hour. This system avoids affecting the hour decimals, which are preserved. For example, if the hour hand indicates 10 hours and 30 minutes, the rotation of the stem will move the hand forward to 11 hours and 30 minutes.

In order achieve this result the timepiece disclosed in the aforecited document includes a first wheel meshing with the gear train and a second wheel able to be driven by the stem when the time is being set. The wheels are coupled to each other by a limited torque mechanism including a spring. It will be clear that, outside periods when the time is being corrected, the first and second wheels remain rigidly coupled to each other, which allows the hour display to be altered without affecting the minutes that complete the hour.

Obtaining the same results, no longer from a stem that is rotated, but from a push-button that is pressed constitutes an advantageous technical advance since it means that a new timepiece can be proposed with combinations that are as yet unknown.

Using a push-button to correct certain time units is known. This is the case for the display of the date or the day of the week, which, for example, implements an actuating finger, which drives the toothing of a ring on which the date or day of the week is displayed which, appears through an aperture. However, this is a simple passage from one number to another, namely a step-by-step movement forward, where there is no need to take into account a fraction or a decimal of the number.

SUMMARY OF THE INVENTION

Thus, in addition to complying with the statement in the first paragraph of this description, the time-setting member for a time indicator according to the present invention is characterized in that it includes a push-button, which, when it undergoes a manual application of pressure, activates a device that in turn acts on said mechanism to uncouple said gear train from said indicator.

The invention will now be explained in detail hereafter by one embodiment given by way of example, this example being given purely by way of non-limiting illustration, and the embodiment being illustrated by the annexed drawings, in which:

DETAILED DESCRIPTION OF THE PREFERRED EMBODIMENTS

Figure 1:
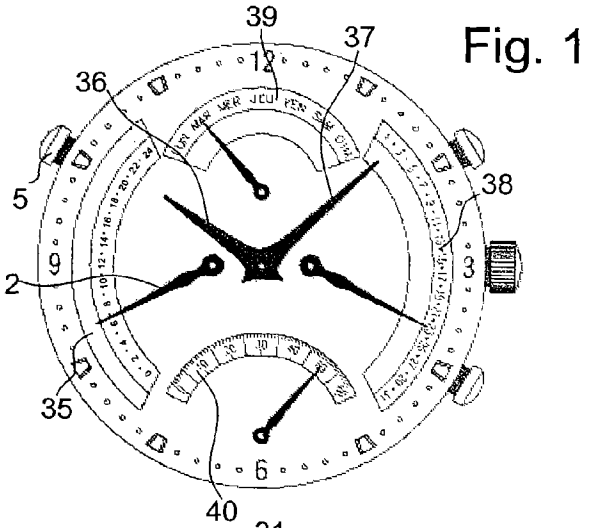
FIG. 1 is a general top view showing a timepiece fitted with a time-setting member according to the invention.

FIG. 1 is a top view of a timepiece including the present invention, more specifically a retrograde 24 hour time display. The time indicator is a hand 2 on which a scale 35 is mounted, arranged in an arc of a circle and extending between 0 and 24, This timepiece can be called a time-zone timepiece, the local time of the place where the person wearing the watch resides being displayed by hand 2 and the time of the time-zone where he is temporarily staying being displayed by a hand 36, this hand being completed by a minute hand 37. The watch of FIG. 1 is completed by a date display 38, a day of the week display 39 and a small second display 40. The time of hand 2 is set by means of a push-button 5. Other arrangements could be envisaged, our interest being focussed on hand 2 whose time is set by push-button 5.

Figure 2:
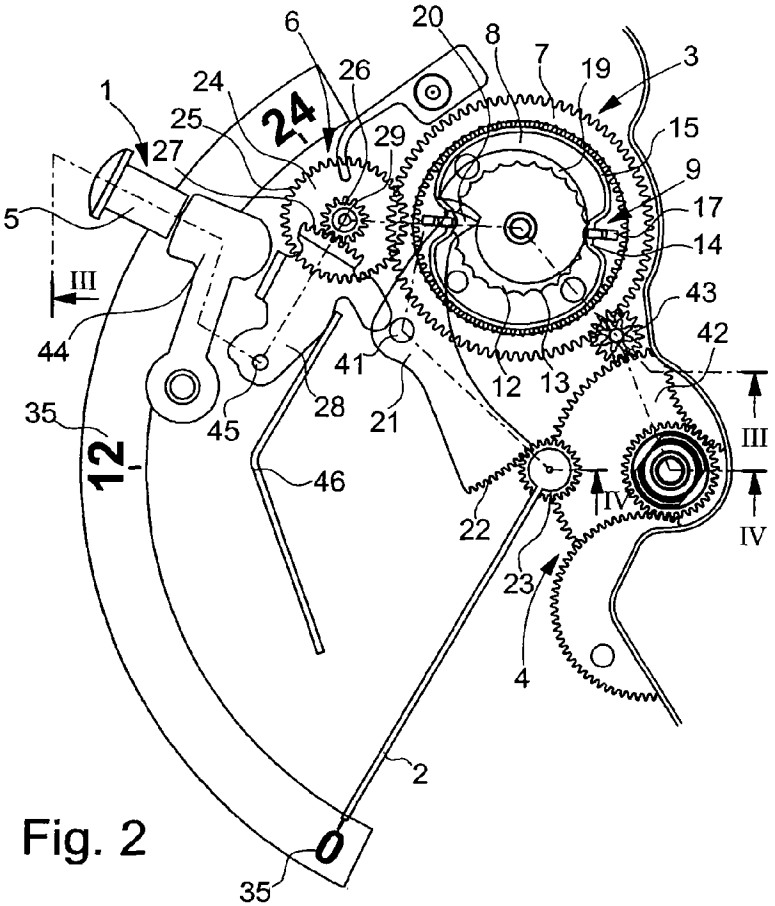
FIG. 2 is a plan view of the embodiment of the mechanism made in accordance with the invention.

FIG. 2 is a plane view of the time display mechanism with the time-setting member according to the invention. This Figure shows a time indicator 2, in this case a hand, able to be set by a member 1. Indicator 2 is driven during normal use by a mechanism 3, the latter being controlled by gear train 4 comprised in the timepiece. Mechanism 3 is arranged for uncoupling gear train 4 from indicator 2 when the time-setting member 1 is actuated, this action then causing the indicator to move forward through a step of one hour.

The above explanation presents an originality, which, according to the invention, consists in implementing a push-button 5 as time-setting member 1 of indicator 2. Again, according to the invention, this push-button, when it undergoes a manual application of pressure, actuates a device 6, which in turn acts on mechanism 3 to uncouple gear train 4 from indicator 2 and thereby move indicator 2 forward through a step of one hour.

Generally, mechanism 3 includes a first wheel 7 controlled by gear train 4 and meshing therewith, and a second wheel 8. This second wheel 8 is coupled on the one hand to the first wheel 7 by means of a spring device 9 and driven, on the other hand, by device 6 actuated by push-button 5 when the latter is actuated to uncouple the first and second wheels from each other and move time indicator 2 forward through one step.

Figure 3:
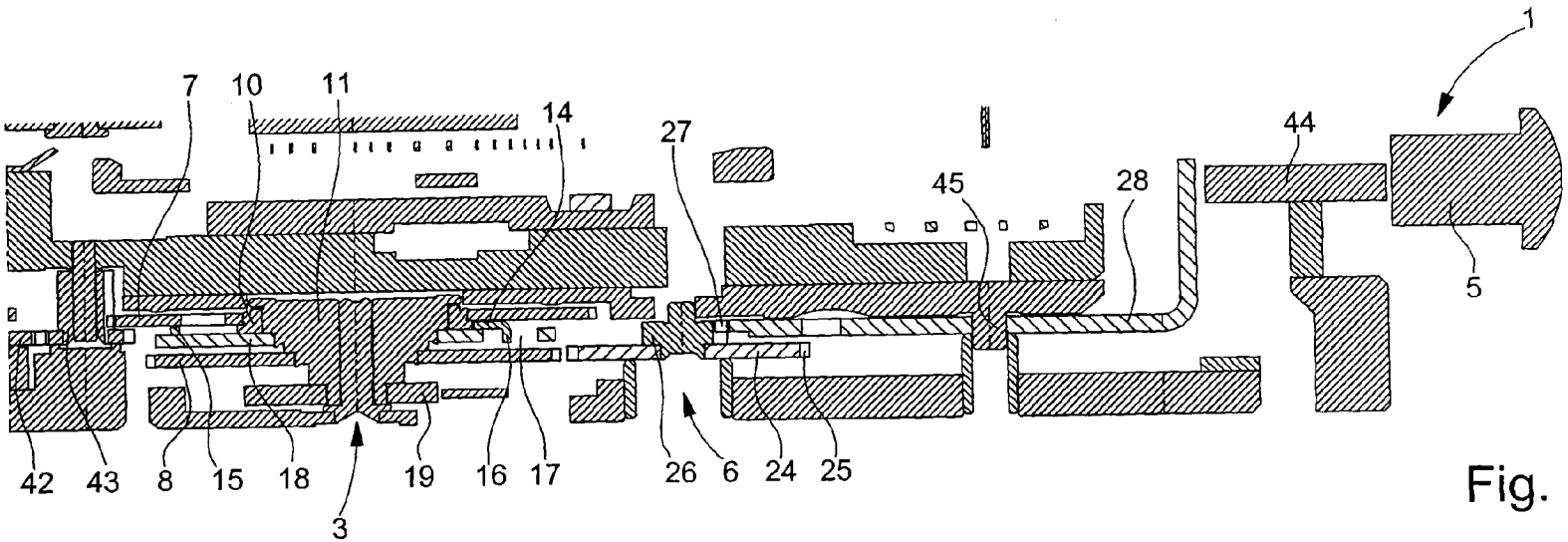
FIG. 3 is a cross-section along the line III-III shown in FIG. 2.
Figure 4:
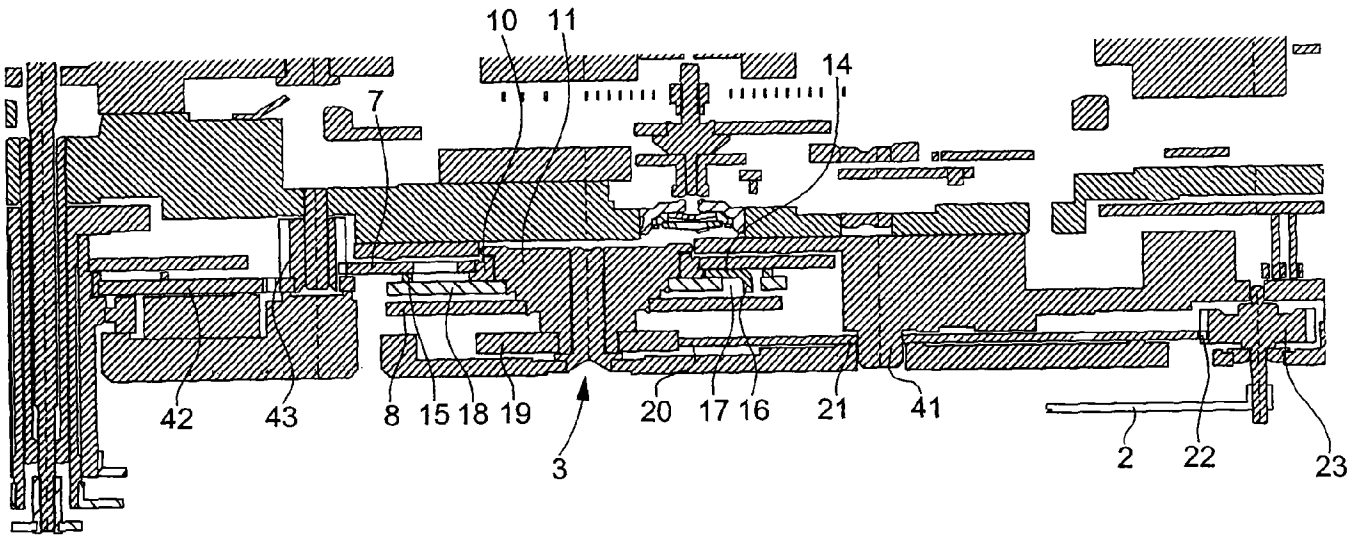
FIG. 4 is a cross-section along the line IV-IV shown in FIG. 2.

More specifically, and as is shown clearly by FIG. 3, which is a cross-section along the line III-III shown in FIG. 3 and FIG. 4, which is a cross-section along the line IV-IV shown in FIG. 2, the first wheel 7 is forcibly fitted onto a crown 10 that rotates freely on a hub 11. Crown 10 has a star-wheel 12 provided with as many teeth 13 as the indicator shows time divisions 35 (see FIG. 2). Two diametrically opposite spaces of star wheel 12 respectively cooperate with two projecting portions 14 of an annular spring 15 surrounding star wheel 12. This spring 15 carries two vertically bent members 16, which dip into two corresponding holes 17 made in a plate 18 forced onto hub 11. FIGS. 3 and 4 also show that the second wheel 8 is forcibly fitted onto hub 11 and that it is capable of meshing with device 6, activated by push-button 5 as will be described in detail hereafter. The time indicator 2 is driven by hub 11. Depending upon the nature of this indicator, the latter can be driven in two ways, one of which will now be described.

FIGS. 2 and 4 show that a cam is forcibly fitted onto hub 11, and a sensor or feeler 20, located at the end of a rack 21, rubs on said cam. The other end of the rack is provided with a toothing 22. The rack is hinged at 41. Toothing 22 of rack 21 meshes with a pinion 23 to the arbour of which a retrograde time indicator 2 is secured.

Time indicator 2 could be directly fitted onto hub 11. There would then be a hand continually rotating on the timepiece dial. This solution is not shown in the drawing.

We have referred several times to the gear train 4 of the timepiece, this gear train driving the first wheel 7 forming part of mechanism 3. The "gear train", also called the going train in horological language, means the train of gears directly connected to the drive element of the timepiece, this drive element mainly consisting of a barrel spring. In the construction taken here by way of example, this gear train 4 ends in an hour wheel 42 to which an hour hand 36 is secured (see FIGS. 1, 2 and 4). Hour hand 36 completes one revolution in 12 hours, and wheel 42, which is connected thereto, meshes on an intermediate wheel 43, which in turn drives the first wheel 7 of mechanism 3. The gear ratio is arranged such that wheel 7 completes one revolution in 24 hours, which means that indicator 2 has a 24 hour display. This first wheel 7 is thus permanently connected to gear train 4 of the timepiece such that if push-button 5 is activated, indicator 2 moves forward through a one hour step while preserving the fraction of an hour that existed before correction.

FIGS. 2 and 3 show an example device 6 actuated by push-button 5 and acting on mechanism 3 to uncouple gear train 4 from indicator 2. This device 6 includes a sliding wheel 24, whose toothing 25 meshes with the second wheel 8 when the push-button is activated. This sliding wheel 24 carries a pinion 26 whose toothing meshes with the toothing 27 of a rack 28, this latter being controlled by push-button 5. In the example construction shown in FIGS. 2 and 3, this control is achieved via a separator lever 44, but it could be achieved directly. A return spring 46 acts on the rack, hinged at 45.

Figure 9:
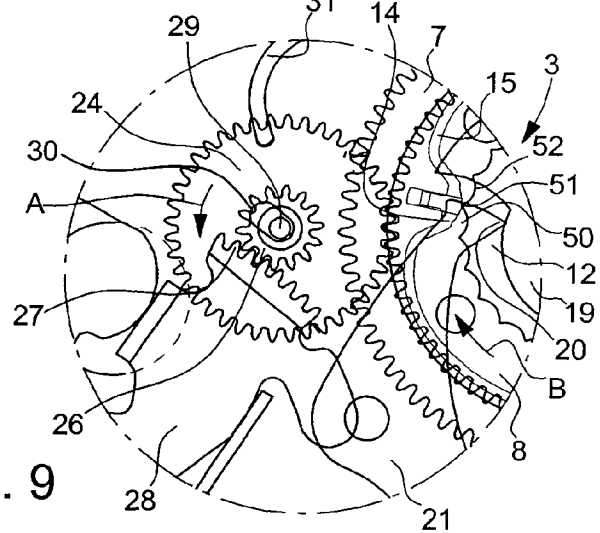
FIG. 9 is an enlargement of the zone IX shown in FIG. 7.
Figure 6:
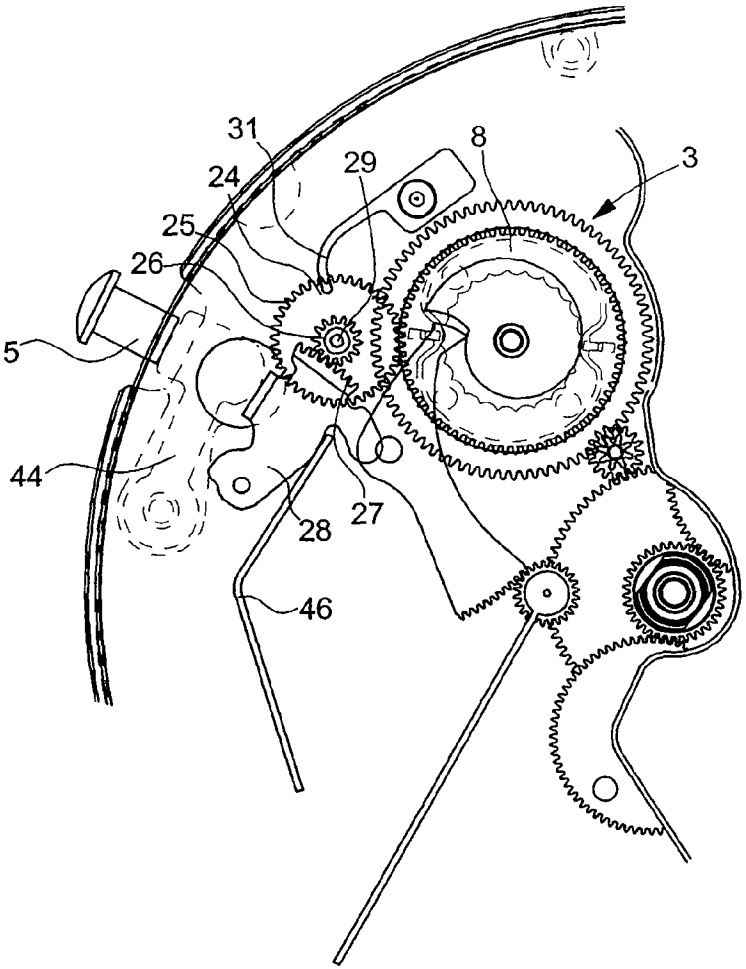
FIGS. 5 to 8 demonstrate four situations of the mechanism to explain the working of the time change function according to the invention when the control push-button is activated.
Figure 7:
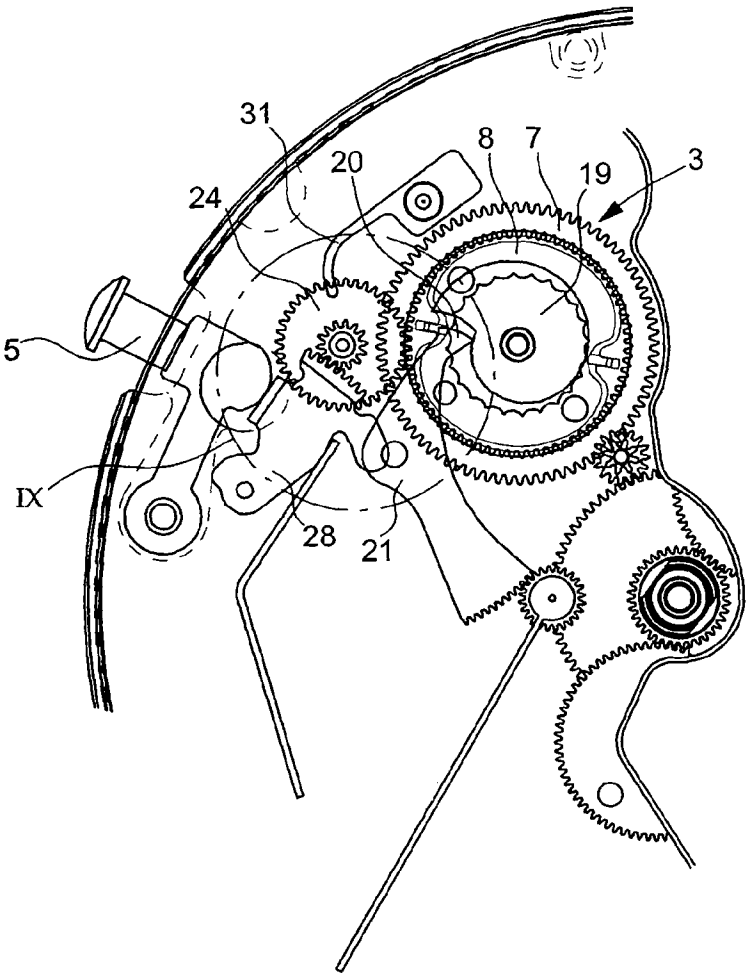

FIGS. 5 to 8 show four situations in the time-setting cycle of indicator 2 and FIG. 9 is an enlargement of the zone IX drawn in FIG. 7. With reference to FIGS. 5 to 9, we will now explain how the time-setting mechanism functions when pressure is applied to push-button 5 in order to make the time indicator change from one hour to another. The reference numerals are the same as those used in FIG. 2.

Figure 5:
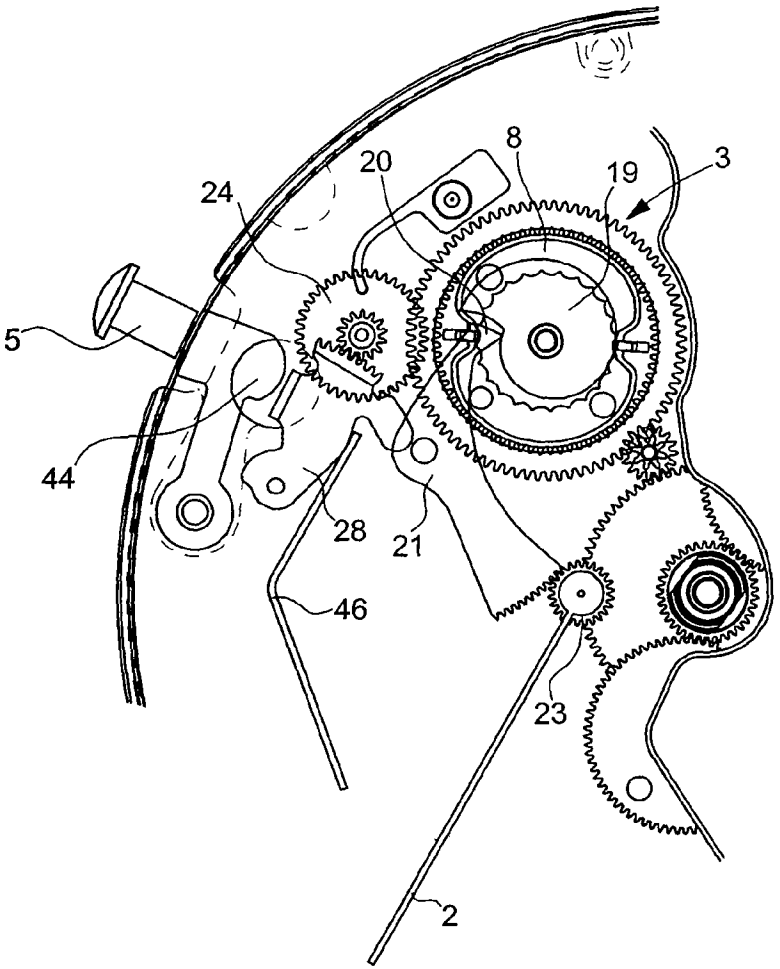

FIG. 5 shows a timepiece in normal operation. Push-button 5 is in the rest position, i.e. subject to no external actuation. Rack 28 is pushed into the end of travel position towards the exterior of the timepiece by return spring 46. Meshing with the rack, sliding wheel 24 is totally released from the second wheel 8 of mechanism 3. Indicator 2 connected to pinion 23 is indicating 0 hours 30 minutes, and sensor 20 of rack 21 is in the area of cam 19 having the smallest diameter.

FIG. 6 shows the same mechanism with a push-button 5 half pushed in. Rack 28 has tipped in the clockwise direction pushed by separator lever 44. Toothing 27 of rack 28 has driven sliding wheel 24 via the pinion 26 thereof in a movement of translation until toothing 25 of sliding wheel 24 is meshed with the toothing of second wheel 8 of mechanism 3. Sliding wheel 24 carries an arbour 29, which is guided into an oblong hole 30, which is not shown in FIG. 6, but which is shown in FIG. 9. This movement of translation is carried out without any rotation of wheel 24. In this situation, arbour 29 of wheel 24 is stopped at the bottom of oblong hole 30 and wheel 8 is still in the same angular position as that shown in FIG. 5. The time indicator is still indicating 0 hours 30 minutes.

FIGS. 7 and 9 show the same mechanism with a push-button 5 pushed-in three quarters of the way of its total travel. Sliding wheel 24 has started to rotate in the anticlockwise direction A driven in rotation by the action of toothing 27 of rack 28 on pinion 26 of said wheel 24 (see FIG. 9). The rotation of sliding wheel 24 has rotated second wheel 8 of mechanism 3 in the clockwise direction B. The projecting portions 14 of annular spring 15 surrounding star-wheel 12 have passed from space 50 of the star-wheel where they were previously onto the tips 51 of said star-wheel and sensor 20 of rack 21 has slightly moved forward along the ramp of cam 19. Hour hand 2 is indicating 1 hour and 00 minutes. It should be noted that the first wheel 7 of mechanism 3 has remained immobile, restrained by the timepiece gear train.

Figure 8:
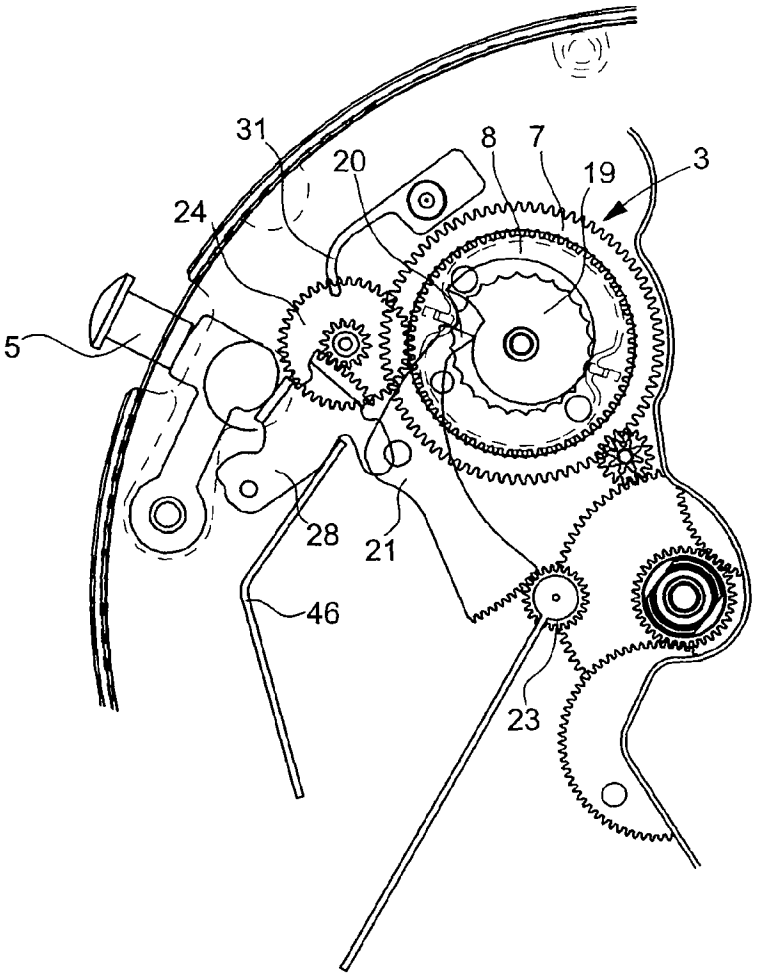

FIG. 8 shows the same mechanism with a push-button pressed all the way in. Sliding wheel 24 has continued to rotate in the same anticlockwise direction driving second wheel 8 of mechanism 3 in the same clockwise direction. It will be clear that the projecting portions 14 of annular spring 15 will have passed the tips 51 of star-wheel 12 where they were previously onto the spaces 52 of said star-wheel (see FIGS. 8 and 9). Sensor 20 of rack 21 has again moved forward along the ramp of cam 19. Hour hand 2 is now indicating 1 hour and 30 minutes and the passage from one hour to the next was carried out while preserving the fraction of 30 minutes affected at the start time.

Once indicator 2 has finished moving forward, the pressure on push-button 5 is released and rack 28 returns to the place that it was occupying, returned by spring 46. This vertically bent portion drives sliding wheel 24 to its start position which is the rest position.

What is claimed is:

1. A time-setting member connected to set a time indicator of a timepiece, wherein the indicator is driven during normal use by a mechanism controlled by a gear train of the timepiece, wherein the mechanism is arranged to uncouple the gear train from the indicator when the time-setting member is actuated, and action of the time-setting member causes the indicator to move forward through a step of one hour, wherein the time-setting member includes a push-button disposed to control, via a lever, a rack provided with toothing, wherein, when the push-button undergoes manual pressure, the rack controlled by the push-button actuates a first device that in turn acts on the mechanism to uncouple the gear train from the indicator, wherein the mechanism controlled by the gear train includes a first wheel meshing with the gear train; and a second wheel coupled to the first wheel by a spring device and driven by the first device activated by the push-button when the push-button is actuated to uncouple the first wheel and the second wheel from each other and to move the time indicator forward one step, and wherein the first device includes a sliding wheel provided with toothing, wherein the toothing of the sliding wheel meshes with the second wheel when the push-button is actuated, and the sliding wheel carries a pinion whose toothing meshes with the toothing of the rack controlled by the push-button.

2. The time-setting member connected to set a time indicator of a timepiece according to claim 1, wherein the first wheel is forcibly fitted onto a crown that rotates freely on a hub, the crown having a star-wheel provided with as many teeth as the indicator has time divisions, wherein two diametrically opposite spaces of the star-wheel respectively cooperate with two projecting portions of an annular spring surrounding the star-wheel, the spring having two vertically bent portions dipping into two corresponding holes made in a plate forced onto the hub, wherein the second wheel is forcibly fitted onto the hub and the time indicator is driven by the hub.

3. The time-setting member connected to set a time indicator of a timepiece according to claim 2, wherein a cam is forcibly fitted onto the hub, and a feeler, located at one end of a rack rubs on the cam, the other end of the rack being provided with a toothing meshing with a pinion onto an arbor of which a retrograde time indicator is fitted.

4. The time-setting member connected to set a time indicator of a timepiece according to claim 2, wherein a circular time indicator is fitted onto the hub.

5. The time-setting member connected to set a time indicator of a timepiece member according to claim 1, wherein an arbor, carried by the sliding wheel is guided into an oblong hole made in a bridge, the wheel first of all making a movement of translation, then a movement of rotation as soon as the toothing thereof is meshed with the second wheel to move the time indicator move forward one step.

6. The time-setting member connected to set a time indicator of a timepiece according to claim 5, wherein a friction spring presses on the sliding wheel to prevent the wheel from rotating when making the movement of translation.

7. The time-setting member connected to set a time indicator of a timepiece according to claim 1, wherein the sliding wheel is movable between a first position and a second position, wherein in the first position, the sliding wheel is not contact with the second wheel, and in the second position, the sliding wheel meshes with the second wheel.

8. The time-setting member connected to set a time indicator of a timepiece according to claim 7, wherein when the sliding wheel moves from the first position to the second position, the sliding wheel slides toward the second wheel, and then rotates to rotate the second wheel when in the second position.

* * * * *